US006149013A

United States Patent [19]

Hughes

[11] Patent Number: 6,149,013

[45] **Date of Patent: *Nov. 21, 2000**

[54] ENHANCED FLOTATION REAGENTS FOR BENEFICIATION OF PHOSPHATE ORES

[75] Inventor: Craig V. Hughes, Valrico, Fla.

[73] Assignee: Custom Chemicals Corporation, New York, N.Y.

[ * ] Notice: This patent is subject to a terminal disclaimer.

[21] Appl. No.: 09/411,252

[22] Filed: Oct. 4, 1999

Related U.S. Application Data

[63] Continuation of application No. 08/950,645, Oct. 15, 1997, Pat. No. 5,962,828.

[51] Int. Cl.[7] ..... B03D 1/012; B03D 1/02

[52] U.S. Cl. ..... 209/166; 252/61

[58] Field of Search ..... 209/166, 167; 252/61

[56] References Cited

U.S. PATENT DOCUMENTS

| | | |
|---|---|---|
| 2,163,702 | 6/1939 | Reid . |
| 2,303,931 | 12/1942 | Greene . |
| 2,373,688 | 4/1945 | Keck . |
| 2,442,455 | 6/1948 | Booth . |
| 3,292,787 | 12/1966 | Fuerstenau . |
| 3,314,537 | 4/1967 | Greene . |
| 3,405,802 | 10/1968 | Preller . |
| 4,133,750 | 1/1979 | Burress . |
| 4,309,282 | 1/1982 | Smith . |
| 4,330,398 | 5/1982 | Alford . |
| 5,147,528 | 9/1992 | Bulatovic . |
| 5,542,545 | 8/1996 | Yu . |
| 5,962,828 | 10/1999 | Hughes . |

*Primary Examiner*—Thomas M. Lithgow
*Attorney, Agent, or Firm*—Dennison, Scheiner, Schultz & Wakeman

[57] ABSTRACT

An improved phosphate ore beneficiation process is disclosed which comprises the employment of a novel combination of surfactants which, when combined with fatty acid collectors, enhances recovery of phosphate minerals in anionic flotation, even when used in plant water. The disclosed surfactants include petroleum sulfonates and ethoxylated alcohol ether sulfates.

12 Claims, No Drawings

ENHANCED FLOTATION REAGENTS FOR BENEFICIATION OF PHOSPHATE ORES

This application is a continuation application of Ser. No. 08/950,645 filed Oct. 15, 1997 now U.S. Pat. No. 5,962,828.

BACKGROUND OF THE INVENTION

1. Field of the Invention

This invention relates to the formulation of a flotation reagent useful in beneficiation of phosphate mineral ore. More particularly, the invention relates to the combination of a fatty acid collector, alcohol ether sulfates, and sulfonated petroleum derivatives in conjunction with fuel oil to afford a novel flotation reagent for phosphate minerals which is more effective than traditional reagents based solely on fatty acids.

2. Description of the Related Art (Including Information Disclosed Under 37 CFR 1.97 and 37 CFR 1.98

Phosphate ore is used to manufacture valuable raw materials, such as phosphoric acid, monoammonium phosphate, diammonium phosphate, triple super phosphate, and other commercial products used in fertilizer production, and in manufacturing other valuable phosphorus-based chemicals. The vast majority of phosphate ore cannot be used in the condition in which it is removed from the earth, as it is present in a matrix containing sand, clay, and other non-valuable constituents. The ore must be beneficiated (a term of art meaning purified or refined) such that the resulting material is enriched with phosphorus-containing minerals and the non-phosphorus, contaminating materials are effectively removed. The common operations involved in beneficiation are washing, sizing, and froth flotation.

Before the matrix is subjected to froth flotation, it is segregated into various particle size fractions through the use of screens and/or hydrocyclones. Typically, the larger particle size fractions (pebble, 14 mesh and larger, or $\leqq 1.18$ mm) contain a relatively high percentage of phosphorus minerals and are blended into the final product that will subsequently be converted to phosphoric acid. Very fine particles (>150 mesh, or >106 $\mu$m), typically composed of phosphate clays (or slimes), are also removed. The particle size range particularly suited for froth flotation is typically, but not limited to, about 150–14 mesh (or, from about 106 $\mu$m to about 1.18 mm) and is known as "float feed" or "rougher feed." Float feed typically does not contain a sufficiently high percentage of phosphate to be chemically converted to phosphoric acid economically; therefore, the non-valuable constituents must be separated to afford a material that can be used further.

Froth flotation utilizes a flotation cell in which an aqueous slurry of the float feed, which has been intimately mixed (i.e., conditioned) with various chemical reagents (called "collectors") and is then dispersed by agitation while air is sparged (bubbled) through the mixture. The unique chemical attributes of the collector allow it to adsorb selectively onto the surface of a specific type of mineral depending upon its chemical composition and, thereby, alter the wetability of the mineral species. The collector typically embodies an anionic moiety which is the point at which molecule-to-mineral attachment occurs. The collector also typically embodies a hydrophobic moiety that is preferentially oriented toward the inside of an air bubble. By this mechanism the mineral-collector complex attaches to the air bubbles which are rising through the slurry (due to the sparging), causing the mineral to float to the surface where it is mechanically removed. The non-valuable mineral constituents (tailings), primarily composed of silica (sand), flow along the bottom of the cell to a drainage point where they are removed.

The most widely used froth flotation process in the phosphate industry is known as the Crago process, which encompasses three stages: (1) anionic (or rougher) flotation, wherein the phosphorus-containing minerals are selectively floated out from conditioned feed; (2) scrubbing, wherein the material collected from anionic flotation is washed with an aqueous solution of sulfuric acid to remove chemical reagents from the surface of the particles, followed by water washing; and (3) cationic (or cleaner) flotation, wherein the scrubbed product is conditioned with another chemical reagent that selectively adsorbs onto the surface of silicate (sand) particles and the silicate minerals are floated, leaving behind a highly phosphorus-enriched final concentrate.

A blend of the final concentrate and pebble is the basic raw material which is used for making phosphoric acid. By analyzing the percentage of phosphorus-containing mineral (grade), usually specified as percent bone phosphate of lime (% BPL), or % $P_2O_5$, in the feed, rougher concentrate, and rougher tailing, one can calculate the metallurgical percent recovery of phosphate mineral in rougher flotation and, therefore, measure the performance of a particular collector. If one also measures the weight of feed as well as the weight of material which is obtained in rougher concentrate and rougher tailings, one can calculate the mass percent recoveries for rougher flotation.

In order to minimize depletion of valuable water resources and costs associated with water purification, the water used to perform the flotation processes in beneficiation plants is recycled. Over time, the reservoir that contains this water can become contaminated with phosphate clays, dissolved inorganic minerals, and colloidal organic matter that are difficult to remove. These contaminants have a deleterious effect upon froth flotation because they often react, either chemically or physically, with the collector thus inhibiting the collector's efficiency. In addition, some of these contaminants are comprised of very fine particles having high surface area to mass ratios that compete effectively with the desired mineral species for available collector molecules. Therefore, the chemical purity of the beneficiation plant water can have a significant impact upon the flotation process and therefore the economical viability of the overall operation.

A considerable body of prior art exists in the patent literature describing "promoters" which have been incorporated in fatty acid based anionic flotation reagents to enhance phosphate mineral flotation, either from phosphate ore or from another mineral ores in which phosphorus-containing minerals are a nuisance species. The following is a summary of those inventions.

U.S. Pat. No. 3,164,549 to J. E. Seymour describes the use of aryl or polyaryl alkyl sulfonates, especially sodium dodecyl benzene sulfonate. A single-step anionic flotation process is used, however, the examples use starting float feeds which contain very high % BPL levels which are not typical of ore reserves now being mined.

U.S. Pat. Nos. 4,138,350, 4,139,481, 4,158,623, 4,192,739, and 4,207,178 to S. S. Wang et al. teach the use of carboxy monosubstituted derivatives of sulfosuccinic acid or its corresponding salts in conjunction with fatty acids as an anionic flotation reagent. While significant improvements in recoveries were demonstrated without sacrifice in rougher concentrate grade, none of these patents address the effects of ionic composition of process water used in flotation.

U.S. Pat. No. 4,199,064 to R. N. Holme describes the use of either the tefrasodium salt of an N-(1,2-dicarboxyethyl)-N-alkylsulfosuccinamate or the disodium salt of the diester analog. This patent does not report the additive levels necessary to achieve enhanced performance (i.e., boosted percent recovery of phosphate), neither does it address the effect of contaminated water upon the performance of flotation.

U.S. Pat. No. 4,330,398 to J. A. Alford reports the use of alkali metal or ammonium salts of sulfated alcohol ethoxylates to enhance anionic flotation of phosphate. The preferred ratio of fatty acid to alcohol ether sulfate is 85:15, whereas in the current invention the ratio is 95:5 wherein the 5% portion is partially comprised of a lower cost material. Also, the typical % BPL of the float feed used in the cited examples is higher than typical ore reserves now being mined.

U.S. Pat. No. 4,337,149 to S. J. Escalera teaches the use of primary, secondary, and tertiary (including heterocyclic) amine oxides as foam modifiers which assist the collectors in supporting absorbed phosphate mineral particles. This patent demonstrates enhanced rougher recovery at low weight percent of the promoter (1.5–6% w/w); however, it does not address the difficulties encountered when attempting to float phosphate ore using plant water.

U.S. Pat. No. 4,358,368 to K. M. E. Hellsten et al. describes the use of quaternary salts of beta-hydroxyglycines or beta-hydroxytaurines as flotation reagents in lieu of traditional fatty acid based anionic flotation reagents. The principle claim of this patent is for a product which can replace fatty acid reagents in terms of performance; however, the economic viability of such a replacement is not addressed. Also, the ore used in the examples of this claim is artificially prepared from a ground sample of phosphate rock and is not very representative of phosphate ores encountered in commercial operations.

U.S. Pat. No. 4,968,415 to H. J. Morawietz et al. describes the use of alkenyl-substituted monoesters of succinic acid to aid in selective recovery of phosphorus-containing minerals using water with a high saline content, especially in phosphate ores that contain high percentages of calcite. The examples shown in this patent, however, do not reflect as great an improvement in recovery of phosphorus-containing mineral as the current invention. In addition, the conditioning and flotation times cited are relatively long and do not reflect current commercial practice.

U.S. Pat. No. 4,995,998 to W. Von Rybinski et al. describes the use of a novel combination of collectors: end-capped fatty alcohol polyglycol ethers with one or more ampholytic surfactants including sarcosides, taurides, N-substituted aminopropionic acids or N-(1,2-dicarboxyethyl)-N-alkylsuccinamates. This patent primarily addresses the recovery of apatite from iron ore tailings and, therefore, does not specifically teach commercial phosphate mining and beneficiation.

U.S. Pat. No. 5,015,367 to R. R. Klimpel et al. reports the usage of alkylated diaryl oxide monosulfonate salts in combination with a polyglycol ether frother for the selective flotation of apatite (a major phosphorus-containing mineral) over dolomite (a major nuisance mineral). The main advantages taught are the low dosage levels of collector required and that no pH modifier is required. However, the particular samples that were subjected to flotation were artificially constructed of clean samples of specific minerals and, thus, not representative of commercial phosphate ores. Additionally, the effect of process water containing high levels of inorganic salts was not addressed.

U.S. Pat. No. 5,108,585 to W. Von Rybinski et al. teaches the use of a combination of alkyl or alkenyl glycosides with either an anionic or ampholytic, non-thioionizable surfactant for froth flotation of non-sulfidic ores. The specific examples that focus upon apatite flotation, however, are run under conditions that are far removed from common commercial practice. Magnetic constituents are first removed from the sample that was floated, and the dosage of the collector was far higher than is typical in commercial practice.

U.S. Pat. No. 5,130,037 to P. Swiatowski et al. describes the use of monoesters of dicarboxylic acid which contain alkylene oxide backbones as a promoter for fatty acid collectors in apatite froth flotation. In some examples, a frother (methylisobutylcarbinol) is also added. The examples cited in this patent utilize phosphate ore samples that are relatively high grade compared to most commercial phosphate ores, and no reference is made to the effects of ionic strength or contamination of process water. In addition, a multi-stage rougher flotation procedure is used which is not common practice for the majority of flotation feed which is processed in the industry.

U.S. Pat. No. 5,147,528 to S. Bulatovic reports a unique composition of ingredients which is used to substitute for (not add to) traditional fatty acid based anionic flotation reagents. The combination consists of a fatty acid residual, tall oil fatty acid pitch, and amine derived from a plant source (and in some examples sarcosine, or methylglycine). The mixture is subsequently oxidized by sparging with oxygen gas for several hours, and the resulting mixture is the invention. The dosage of reagent used in all examples is significantly higher than that used in common practice in the industry, and it is known that the potential for "overdosing" (i.e., adding too much reagent such that the performance is less than optimum) can be achieved. The inventor does not describe any attempt to optimize the performance level of the individual reagents; therefore, an overall cost-benefit comparison cannot be made. In addition, some examples used for comparison between commercially used flotation reagents and those of the invention utilize two different flotation schemes. Therefore, the conditions under which the advantage of the invention is demonstrated are different than those used for conventional reagents.

U.S. Pat. Nos. 5,171,427 and 5,173,176 to R. R. Klimpel et al. teaches the use of alkylated, aryl monosulfonic acid salts to enhance recovery of apatite mineral from apatite-silica mixtures. The examples in this patent are not based upon commercial grade of phosphate ore; however, the relative proportions of apatite and silica contained therein are roughly representative of commercial phosphate ores. While this patent may address the effects of ionic strength of process water upon the effectiveness of the promoter, it does not address the effect of slimes. In addition, the use of a frother at 0.1 lb/ton is required. Flotation is carried out at ambient pH which does represent a substantial cost savings compared to conventional practice wherein typical modifiers are used (soda ash, caustic, etc.). The examples show ratios of the sulfonate salts to fatty acid from 3:1 to 1:1; whereas, in the current invention said ratio is 1:9 or less. Dosages of promoter are reported in the range of 0.5–1.0 lbs/ton, which is in alignment with industry practice. Also, the potential for scrubbing (removal of anionic flotation reagent from mineral surface) problems commonly associated with the use of sulfonates is not addressed.

U.S. Pat. No. 5,295,584 to J. M. Krause et al. teaches the use of salts of monoesterified, alkenyl-substituted succinic acids as either a supplement to or substitute for traditional fatty acid based collectors in anionic flotation. The use of nuisance mineral depressants, most notably causticized starch, is also incorporated. One type of phosphorus ore utilized is extremely fine and of high grade; and, although exhaustive consideration is taken of the effect of hard water upon flotation performance, this ore and the conditions under which it is pretreated prior to flotation are far removed from commercial practice. Another type of ore, which much more closely simulates ores being currently mined today, is also investigated. The effect of hard water upon this latter ore is not specifically investigated, and again the conditions under which pretreatment is conducted do not resemble current commercial practice.

U.S. Pat. No. 5,314,073 to M. K. Sharma et al. reports the use of a novel promoter for anionic flotation-a polymer which is prepared from a diol, a diacid (or its salt/ester analog), and a difunctionally substituted aryl sulfonic salt. While addition of this promoter does enhance recovery of phosphate minerals in anionic flotation, the amount of the promoter which is added to a 1:1 mixture of fuel oil with a traditional fatty acid reagent is equivalent to or greater than the amount of fatty acid which can be displaced. Therefore, in order to achieve real economic benefit, the cost for the additive would have to be nearly the same as the fatty acid component, which is unrealistic. In addition, the process water used in the examples of this patent does not take into account the effect of dissolved ionic species upon flotation.

U.S. Pat. No. 5,441,156 to B. Fabry et al. claims the use sulfonated oleic acid and/or sulfonated rapeseed oil with any and all combinations of either anionic or nonionic surfactants, including petroleum sulfonates and ether sulfates; however, no specific examples are given where the combination of these two are used. The principle object of the invention is removal of apatite from iron ore.

U.S. Pat. No. 5,542,545 to Y. X. Yu claims the use of a combination of tall oil fatty acid-based oil anionic flotation reagent containing as a minor constituent a combination of: a sulfonated fatty acid; an alkyl alcohol sulfate; an alkyl alcohol ether sulfate; and, optionally, an N-substituted-N-alkoxypropylmaleimic acid derivative. The examples used to justify the claims are based upon plant recovery results. The test results are compared with so called "metallurgical-objective recovery" results which are calculated based upon a statistical relationship between historical production data for non-promoted tall oil fatty acid based anionic flotation reagents and that of the invention described herein. The exact mathematical formula for this calculation is not disclosed. In addition, neither specific examples nor related structural features of the particular chemical constituents are given, but are only generically described. Of the three examples cited, the sum of percentages of the formula ingredients in two examples do not add up to 100%; therefore, either the quantities are mis-stated or something has been omitted. Also, rather than providing for any direct comparison of formulas under controlled conditions, the disclosure uses an arbitrary standard from which conclusions regarding the superiority of the invention are drawn.

SUMMARY OF THE INVENTION

The invention improved phosphate ore beneficiation process comprises the employment of a novel combination of surfactants which, when combined with fatty acid collectors, enhances recovery of phosphate minerals in anionic flotation, even when used in plant water (commonly contaminated with process interfering materials, such as phosphate clays, dissolved inorganic salts, colloidal organic matter, and mixtures thereof). The invention surfactants are blends of petroleum sulfonates and ethoxylated alcohol ether sulfates.

DESCRIPTION OF THE PREFERRED EMBODIMENT(S)

The invention process described herein improves both anionic and overall recovery of phosphate minerals compared to typical fatty acid based reagents. Surprisingly, the invention process also works in the presence of contaminated water and does not cause degradation in grade of the rougher concentrate, thereby not affecting consumption of cationic flotation reagents per unit mass of cleaner flotation feed. The invention also improves the rate at which material is floated, which is of commercial interest for operations in which productivity must be maximized to meet contractual obligations and economic goals.

Previous laboratory work has shown that the chemical composition of water used in flotation can have a significant impact upon performance. Since the composition of water in a phosphate mine is changing constantly and since water which is stored for extended periods of time will undergo chemical changes, it was believed that in order to remove the effect of water composition in our experimental design it would be necessary to create a "synthetic water" formulary which can be prepared just prior to flotation.

Samples of plant water from several active phosphate mines were obtained and analyzed for concentration of anions, cations, and total suspended solids. Based upon this analytical information, a synthetic water formulary was created wherein addition of various inorganic salts to deionized water at specific concentrations would afford a solution which would be representative of typical plant water. This synthetic water was then utilized in all subsequent flotation work after "optimum conditions" had been established (see Example 1) up to the point where the invention is fully realized. Flotation performance was then confirmed using actual process water from a phosphate mine.

The improvements provided by the invention process were determined as follows:

A statistically-designed response surface experiment was conducted to determine the conditions (pH, dosage, sparge rate and conditioning time) at which a commercially available fatty acid reagent (Liqro FM from Westvaco Corp.) showed optimum performance, as seen in the Examples to follow. Based on the data generated (Table 1), the optimal flotation conditions were determined (Table 2). Using these optimal conditions, ten promoters which are representative of ten different chemical classes were blended into the benchmark fatty acid flotation reagent at 1, 3, and 5 percent by weight and floated. Based upon the results obtained, the three candidates that showed the best enhancement in flotation performance were used in further experimentation (see examples).

A simplex lattice mixture experiment was conducted to examine the combination of the three promoters to determine the optimum blend that would afford maximum performance enhancement in comparison to a fatty acid reagent without promoter (current practice). The chemical classes of the three promoters that were investigated include an alcohol ether sulfate, a petroleum sulfonate, and an alkali metal salt of a sulfonated tall oil fatty acid. Mixtures of the three promoters at varying percentages in the benchmark fatty acid were floated using the same conditions as aforementioned. The optimum blend was determined by assay of the rougher concentrate and rougher tailings and subsequently calculating the recovery and efficiency as shown below. The optimum blend was found to be approximately a 1:1 mixture of the petroleum sulfonate and alcohol ether sulfate.

In evaluating the respective flotation reagents tested, calculations were made to measure product recovery and efficiency of the float using the following formulas:

$$\text{Metallurgical \% Recovery} = \frac{100\,(\text{Grade Conc. (Grade Feed} - \text{Grade Tails})}{\text{Grade Feed (Grade Conc.} - \text{Grade Tails})}$$

$$\text{Mass \% Recovery} = \frac{100\,(\text{Grade} \times \text{Wt. Conc.})}{(\text{Grade} \times \text{Wt. Conc.}) + (\text{\% BPL Tails} \times \text{Wt. Tails})}$$

$$\text{Efficiency} = \frac{100\,(\text{Recovery} - \text{Wt. \% Conc.})}{100 - \text{Grade}}$$

Recovery values indicate the amount of valuable phosphate mineral that was obtained in the rougher concentrate as a percentage of the total available in the feed. Typically, the higher the recovery, the lower the grade, or the higher the grade, the lower the recovery. In order to assess which conditions provide the best possible combination of achievable recovery and grade, one can calculate the efficiency, which incorporates both grade values and recovery values.

In the examples to follow, blends of Liqro FM containing a 1:1 mixture of petroleum sulfonate and alcohol ether sulfate, at varying percentages, were investigated to determine the percentage of promoter needed to see significant enhancements in recovery, as well as to determine the dosage levels (pounds per dry ton of feed) that would be required to achieve a flotation response that parallels commercial practice (i.e., achieves acceptable recovery and grade). The results of these experiments were compared with those obtained using standard fatty acid without promoter. Recoveries were enhanced in a range of about 8–45% at dosage levels in which a reasonable amount of commercially acceptable material was floated (1.0–1.4 pounds per ton of dry feed).

Also, in the following examples, further experiments were conducted in which equal amounts of phosphate feed were floated using Liqro FM and using Liqro FM containing 4.5% by weight of a 1:1 mixture of petroleum sulfonate and alcohol ether sulfate. The rougher concentrate obtained from the promoted reagent (i.e., alcohol ether sulfate/petroleum sulfonate-containing) was approximately 48% more by weight than that obtained from flotation with Liqro FM alone. In addition, the grade of that material was higher than the material obtained from Liqro FM alone. Equal quantities of the rougher concentrates were scrubbed with 20% sulfuric acid under similar conditions (pH=3.2 for 3 minutes), rinsed thoroughly with water, and subsequently floated with a commercially available cationic flotation reagent (WCA-35A from Westvaco). The amount of material floated was similar for each material. While the % BPL of the tailings from the float using "rougher concentrate" material generated with promoted fatty acid was higher, the overall recovery (anionic and cationic) was higher for the promoted fatty acid generated material than for the material generated using unpromoted (i.e., no alcohol ether sulfate/petroleum sulfonate component) fatty acid reagent.

EXAMPLE 1

A fifteen-run, three-level response surface design was created to determine optimal flotation conditions for a standard fatty acid reagent (Liqro FM from Westvaco) using a commercial sample of fine phosphate ore feed and plant process water from Cargill S. Ft. Meade mine. The following process variables were investigated: sparge rate (10, 20, and 30 mm); conditioning time (60, 90, and 120 seconds); and amount of 10% caustic added during conditioning (1.0, 1.4, and 1.8 ml). The amount of caustic added roughly corresponded to pH levels of 8.5, 9.0, and 9:75. Table 1 below gives the results.

Flotation was conducted for 60 seconds using a 1.6 pound per ton loading of a 1:1 mixture of fatty acid with #5 fuel oil. During the preparation of the float charges, 1200 g of float feed was weighed out per charge. Three representative samples of feed were also collected and analyzed for percent solids using a microwave technique. Based upon the average percent solids of these three samples, sufficient water was added to each charge such that the percent solids, during conditioning, was adjusted to 72%. The amount of reagent added was calculated based upon the assumption that 1200 g of wet feed would afford a 1000 g dry feed weight.

TABLE 1

Response Surface Design to Determine Optimal Flotation Conditions

| | Sparg | | | | Concentrate | | | Tailing | | | Mass | Met | |
|---|---|---|---|---|---|---|---|---|---|---|---|---|---|
| Run No. | % (mm) | Cond Time | NaOH (ml) | pH | wt (g) | % BPI | % Insol | wt (g) | % BPI | % Insol | % Recovery | % Recovery | Efficiency |
| 1 | 30 | 90 | 1.8 | 9.74 | 271.69 | 44.08 | 39.15 | 731.14 | 4.12 | 96.64 | 79.91 | 80.32 | 94.45 |
| 2 | 20 | 60 | 1.8 | 9.68 | 221.87 | 34.87 | 52.16 | 782.92 | 9.13 | 89.36 | 51.97 | 53.83 | 45.89 |
| 3 | 20 | 90 | 1.4 | 9.05 | 213.99 | 53.65 | 25A3 | 787.68 | 4.29 | 96.78 | 77.27 | 77.94 | 120.62 |
| 4 | 20 | 90 | 1.4 | 9.09 | 219.09 | 53.09 | 26A5 | 792.17 | 4.01 | 95.02 | 78.56 | 79.56 | 121.28 |
| 5 | 10 | 90 | 1.4 | 9.06 | 96.63 | 51.68 | 27.82 | 893.25 | 10.77 | 84.78 | 34.17 | 36.52 | 50.51 |
| 6 | 30 | 60 | 1.4 | 9.01 | 119.93 | 47.49 | 33.09 | 881.38 | 10.36 | 88.22 | 38.41 | 40.43 | 50.35 |
| 7 | 30 | 120 | 1.4 | 9.08 | 234.95 | 53.50 | 24.64 | 764.25 | 2.76 | 98.42 | 85.64 | 86.24 | 133.60 |
| 8 | 10 | 120 | 1.4 | 9.01 | 214.72 | 58.77 | 19.72 | 795.15 | 3.08 | 97.20 | 83.77 | 84.11 | 151.62 |
| 9 | 10 | 90 | 1.0 | 8.48 | 27.81 | 53.17 | 27.29 | 974.39 | 13.88 | 83.03 | 9.85 | 11.33 | 15.12 |
| 10 | 20 | 120 | 1.0 | 8.48 | 133.77 | 64.01 | 10.76 | 876.94 | 7.40 | 92.10 | 56.89 | 57.86 | 121.30 |
| 11 | 20 | 60 | 1.0 | 8.54 | 17.73 | 49.44 | 31.44 | 973.49 | 14.37 | 82.43 | 5.90 | 7.29 | 8.12 |
| 12 | 30 | 90 | 1.0 | 8.52 | 44.44 | 59.80 | 18.56 | 955.68 | 13.03 | 83.20 | 17.59 | 17.93 | 32.70 |
| 13 | 20 | 120 | 1.8 | 9.81 | 187.46 | 51.01 | 31.29 | 811.13 | 6.78 | 92.52 | 63.47 | 63.70 | 91.25 |
| 14 | 20 | 90 | 1.4 | 9.15 | 115.81 | 61.83 | 16.72 | 884.5 | 9.00 | 89.04 | 47.35 | 47.51 | 93.74 |
| 15 | 10 | 60 | 1.4 | 9.14 | 71.06 | 50.89 | 24.00 | 930.11 | 11.74 | 85.14 | 24.88 | 29.26 | 36.21 |

The response variables, grade, recovery, and efficiency were analyzed using a statistical DOE software package, and the following "optimal" settings (shown in Table 2) were found based upon the results given in Table 1.

TABLE 2

Optimized Flotation Conditions Using Liqro FM

| | Process Variables | | |
|---|---|---|---|
| Response Variables | 10% NaOH (ml) | Sparge Rate (mm) | Conditioning Time (s) |
| Grade | 1.0 | 21 | 120 |
| Recovery | 1.5 | 25 | 120 |
| Efficiency | 1.4 | 24 | 120 |

EXAMPLE 2

A ten-run simplex mixture design was created to determine the optimal blend of three promoter candidates that were investigated: a sulfonated tall oil fatty acid, an alcohol ether sulfate, and a petroleum sulfonate. Blends of these three promoter were incorporated into Liqro FM at a level of 5% by weight (see Table 3). Flotation was conducted as described in example 1 with the following modifications: (1) sparge rate for all floats was 22 mm; (2) amount of 10% NaOH added to all floats was 1.4 ml; and (3) upon introducing the conditioned sample into the flotation cell, the sample was agitated for five seconds prior to application of sparging.

TABLE 3

Mixture Design to Determine Optimal Blend of Promoters

| | Promoters (wt %) | | | | Concentrate | | | Tailing | | | Met | Mass | |
|---|---|---|---|---|---|---|---|---|---|---|---|---|---|
| Run No. | Sulf. TOFA | Petro Snif | AES | pH | wt (g) | % BPI | % Insol | wt (g) | % BPI | % Insol | % Recovery | % Recovery | Effi-ciency |
| 1 | 5.00 | 0.00 | 0.00 | 8.76 | 283.46 | 44.03 | 41.65 | 709.24 | 3.66 | 97.00 | 82.71 | 82.78 | 96.88 |
| 2 | 0.00 | 5.00 | 0.00 | 8.91 | 270.22 | 47.88 | 36.76 | 718.03 | 3.32 | 97.22 | 83.89 | 84.43 | 109.52 |
| 3 | 1.67 | 1.67 | 1.67 | 9.01 | 279.88 | 47.93 | 35.89 | 719.48 | 2.54 | 98.42 | 87.92 | 88.03 | 115.29 |
| 4 | 0.00 | 0.00 | 5.00 | 9.01 | 240.39 | 54.73 | 26.30 | 757.26 | 2.59 | 97.08 | 87.02 | 87.02 | 139.01 |
| 5 | 0.00 | 2.50 | 2.50 | 9.00 | 265.69 | 50.75 | 33.43 | 724.98 | 2.54 | 97.78 | 87.65 | 88.01 | 124.42 |
| 6 | 2.50 | 2.50 | 0.00 | 8.94 | 280.90 | 45.59 | 39.58 | 709.69 | 3.27 | 94.02 | 84.49 | 84.67 | 103.49 |
| 7 | 2.50 | 0.00 | 2.50 | 9.01 | 281.91 | 48.10 | 36.19 | 727.43 | 7.29 | 98.28 | 61.18 | 71.90 | 84.73 |
| 8 | 5.00 | 0.00 | 0.00 | 8.98 | 279.97 | 44.35 | 41.30 | 707.35 | 3.66 | 96.02 | 82.66 | 82.74 | 97.73 |
| 9 | 0.00 | 5.00 | 0.00 | 9.02 | 291.52 | 45.83 | 37.43 | 709.12 | 2.72 | 93.46 | 87.21 | 87.38 | 107.52 |
| 10 | 0.00 | 0.00 | 5.00 | 8.78 | 292.11 | 44.22 | 37.86 | 694.42 | 2.59 | 98.12 | 88.06 | 87.77 | 104.26 |

EXAMPLE 3

Flotation was conducted as described in Example 2 with the following modifications: (1) the dosage was varied over a range of 1.0–1.4 pounds per dry ton (see Table 4); (2) the fatty acid portion of the flotation reagent contained 0.0, 1.5, 3.0, 4.5, or 6.0 weight percent of a 1:1 blend of alcohol ether sulfate and petroleum sulfonate; (3) the charge in the flotation cell was allowed to agitate for five seconds prior to application of sparging; and (4) float fractions were collected separately every fifteen seconds in order to assess if any rate benefit was achieved. Table 4 shows the performance benefit, and Table 5 shows rate data.

TABLE 4

Determination of Amount of Promoter Blend Required to Achieve Significant Performance Enhancement

| Dosage | Percent | Concentrate | | | Tailings | | | Mass % | Met % | Effi- |
|---|---|---|---|---|---|---|---|---|---|---|
| (lbs/ton) | Promoters | wt (g) | % BPI | % Insol | wt (g) | % BPI | % Insol | Recovery | Recovery | ciency |
| 1.0 | 0.0 | 31.40 | 51.68 | 25.06 | 958.67 | 10.05 | 82.68 | 14.42 | 11.90 | 23.28 |
| | 1.5 | 40.67 | 53.74 | 23.43 | 943.48 | 9.73 | 81.75 | 19.24 | 15.21 | 32.65 |
| | 3.0 | 48.56 | 57.22 | 19.84 | 941.37 | 8.84 | 84.58 | 25.03 | 24.18 | 47.05 |
| | 4.5 | 68.10 | 59.42 | 17.51 | 924.18 | 7.81 | 84.85 | 35.93 | 34.21 | 71.62 |
| | 6.0 | 76.95 | 60.24 | 16.97 | 921.77 | 7.53 | 85.19 | 40.06 | 36.87 | 81.36 |
| 1.1 | 0.0 | 58.90 | 62.38 | 15.56 | 938.54 | 10.10 | 83.45 | 27.94 | 10.88 | 58.57 |
| | 1.5 | 51.20 | 58.61 | 19.34 | 940.44 | 10.53 | 82.66 | 23.26 | 6.41 | 43.73 |
| | 3.0 | 46.52 | 62.84 | 14.55 | 949.32 | 10.44 | 83.68 | 22.78 | 7.26 | 48.73 |
| | 4.5 | 699.49 | 64.45 | 13.60 | 929.38 | 8.85 | 85.44 | 35.27 | 23.62 | 79.63 |
| | 6.0 | 72.99 | 65.17 | 12.79 | 920.65 | 9.00 | 85.76 | 36.47 | 22.05 | 83.61 |
| 1.2 | 0.0 | 64.52 | 65.65 | 13.81 | 931.83 | 9.61 | 83.89 | 32.11 | 15.79 | 74.62 |
| | 1.5 | 90.19 | 59.86 | 16.98 | 905.18 | 8.29 | 85.39 | 41.83 | 29.43 | 81.64 |
| | 3.0 | 95.68 | 59.86 | 17.78 | 885.30 | g.19 | 85.82 | 44.14 | 30.48 | 85.66 |
| | 4.5 | 121.46 | 61.45 | 17.71 | 880.99 | 6.39 | 88.06 | 57.01 | 47.44 | 116.45 |
| | 6.0 | 137.45 | 60.87 | 15.76 | 855.92 | 3.27 | 90.84 | 74.96 | 74.61 | 156.21 |
| 1.3 | 0.0 | 94.29 | 61.58 | 15.08 | 901.77 | 6.21 | 86.64 | 50.90 | 49.03 | 107.85 |
| | 1.5 | 104.48 | 63.99 | 13.84 | 896.74 | 5.84 | 88.02 | 56.07 | 52.18 | 126.71 |
| | 3.0 | 136.59 | 60.52 | 16.56 | 860.03 | 3.55 | 90.22 | 73.03 | 72.29 | 150.26 |
| | 4.5 | 146.74 | 61.37 | 15.14 | 847.77 | 2.70 | 91.88 | 79.75 | 79.20 | 168.24 |
| | 6.0 | 157.23 | 62.40 | 14.39 | 837.44 | 1.74 | 92.92 | 87.07 | 86.76 | 189.53 |
| 1.4 | 0.0 | 103.23 | 61.34 | 16.22 | 886.01 | 5.86 | 87.64 | 54.96 | 52.27 | 15.15 |
| | 1.5 | 133.93 | 59.65 | 20.09 | 858.93 | 5.96 | 88.70 | 60.93 | 51.47 | 117.56 |
| | 3.0 | 151.66 | 62.44 | 14.26 | 833.24 | 2.17 | 93.10 | 83.99 | 83.40 | 182.60 |
| | 4.5 | 180.98 | 61.90 | 14.74 | 819.38 | 0.04 | 95.16 | 99.74 | 99.74 | 214.32 |
| | 6.0 | 165.64 | 63.03 | 14.26 | 329.91 | 1.82 | 92.47 | 87.36 | 86.10 | 191.30 |

TABLE 5

| Rate of Flotation - Cumulative Percent by Weight | | | | | | |
|---|---|---|---|---|---|---|
| Percent | | Percent of Floated Material at Dosage (lbs/ton) | | | | |
| Promoter | Time (%) | 1.0 | 1.1 | 1.2 | 1.3 | 1.4 |
| 0.0 | 15 | 0.69 | 1.30 | 1.80 | 2.40 | 3.10 |
| | 30 | 1.68 | 3.62 | 4.14 | 5.84 | 6.59 |
| | 45 | 2.50 | 5.08 | 5.61 | 8.06 | 9.00 |
| | 60 | 3.17 | 5.91 | 6.48 | 9.47 | 10.44 |
| 1.5 | 15 | 1.06 | 1.28 | 2.22 | 3.05 | 4.04 |
| | 30 | 2.47 | 3.15 | 5.45 | 6.99 | 9.28 |
| | 45 | 3.46 | 4.40 | 7.61 | 9.23 | 12.16 |
| | 60 | 4.13 | 5.16 | 9.06 | 10.44 | 13.53 |
| 3.0 | 15 | 1.34 | 1.30 | 2.52 | 3.78 | 4.63 |
| | 30 | 3.00 | 3.00 | 6.08 | 9.18 | 10.92 |
| | 45 | 4.16 | 4.05 | 8.34 | 12.17 | 13.95 |
| | 60 | 4.91 | 4.67 | 9.75 | 13.71 | 15.40 |
| 4.5 | 15 | 1.89 | 1.94 | 3.33 | 4.20 | 6.22 |
| | 30 | 4.37 | 4.55 | 7.75 | 10.08 | 14.03 |
| | 45 | 5.89 | 6.11 | 10.49 | 13.26 | 16.96 |
| | 60 | 6.86 | 6.96 | 12.12 | 14.76 | 18.09 |
| 6.0 | 15 | 2.07 | 1.85 | 4.01 | 5.04 | 5.54 |
| | 30 | 4.85 | 4.73 | 9.46 | 11.47 | 12.48 |
| | 45 | 6.60 | 6.41 | 12.24 | 14.33 | 15.39 |
| | 60 | 7.70 | 7.35 | 13.84 | 15.81 | 16.64 |

From Table 5, one can see that the rate of flotation, as measured in cumulative percent mass of rougher feed (which was floated in 15-second increments, increases proportionately with the percentage of promoter in the fatty acid.

EXAMPLE 4

A phosphate feed sample, analyzed to contain 11.11% BPL, 79.99% Insol, and 83.3% solids was divided into thirty (30) charges of 1200 g each. Fifteen charges were floated with Liqro FM containing no promoter proportionate to 1.2 lbs/ton. Similarly, fifteen charges of feed were floated with Liqro FM containing 4.5% by weight of a 1:1 mixture of alcohol ether sulfate and petroleum sulfonate. The amount of wet rougher concentrate obtained from flotation with unpromoted fatty acid was 1672.9 g which was analyzed to be 77.41% solids, therefore the amount of dry rougher concentrate obtained was 1295.0 g (8.64%). By contrast, the amount of rougher concentrate obtained from flotation using promoted fatty acid was 2604.4 g analyzed to be 73.71% solids, for a dry feed total of 1919.7 g (12.80%). The grade of the concentrate obtained via unpromoted flotation was assayed to be 56.93% BPL, and the grade of the concentrate from the promoted flotation was found to be 62.67%. The amount of rougher concentrate obtained using promoted fatty acid was higher in both mass (weight) and grade than that obtained with the standard fatty acid reagent; therefore, rougher mass percent recovery was higher.

Two separate charges of 800 g of wet concentrate (619.3 g dry) from unpromoted flotation were weighed out, and sufficient process water was added (438.6 g) to bring the solids to 50%. Two 840.2 g charges of wet concentrate (619.3 g dry) from promoted flotation were weighed out, and sufficient process water was added (398.4 g) to bring the solids to 50%. Each charge was subsequently scrubbed for three minutes with 20% sulfuiric acid addition such that the pH was maintained in the range of 3.00–3.25 during the scrubbing period. After scrubbing, each charge was thoroughly washed over a 200 mesh screen (to retain material having a particle diameter >75 $\mu$m) and then subjected to cationic flotation using a 5% aqueous solution of WCA-35A. Table 6 shows the results.

TABLE 6

| Scrubbing and Cleaner Float Comparison | | | | | | | | | |
|---|---|---|---|---|---|---|---|---|---|
| Percent | Cleaner Concentrate | | | Cleaner Tailings | | | Cleaner Mass Percent | Cleaner | Overall Mass Percent |
| Promoter | Wt (g) | % BPI | % Insol | Wt (g) | % BPI | % Insol | Recovery | Efficiency | Efficiency |
| 0.0 | 370.15 | 70.74 | 5.12 | 105.92 | 7.86 | 87.04 | 97.45 | 67.33 | 15.72 |
| 0.0 | 378.61 | 68.76 | 8.06 | 83.22 | 4.09 | 92.54 | 98.57 | 53.10 | 15.63 |
| 4.5 | 385.76 | 71.57 | 4.62 | 87.37 | 17.79 | 73.43 | 95.48 | 49.05 | 16.57 |
| 4.5 | 400.40 | 71.57 | 4.32 | 72.68 | 12.18 | 81.16 | 96.66 | 42.30 | 17.20 |

While the cleaner percent recovery was slightly less for amine feed generated from promoted anionic flotation, the overall recovery (percentage of phosphate mineral in the feed which was obtained in the final concentrate) was higher.

The invention is further described as set forth in the following claims.

What is claimed is:

1. An improved process for beneficiating phosphate ore comprising washing, sizing, and beneficiating phosphate ore feed particles by anionic froth flotation, wherein the improvement comprises using as the flotation collector a fatty acid based reagent comprising about 0.1–99.9% of a blend of ether sulfates selected from the group consisting of an alkyl ether sulfate, an alkyl alcohol ether sulfate, and, mixtures thereof with a petroleum sulfonate, wherein the blend is present in an amount in the range of about 1:99–99:1% by weight of the phosphate ore.

2. The improved process of claim 1 wherein the blend further comprises fuel oil in an amount ranging from about 20–80%, by weight.

3. The improved process of claim 1 wherein the blend further comprises water.

4. The improved process of claim 3 wherein the water further comprises a contaminant materials selected from the group of materials consisting of phosphate clays, dissolved inorganic salts, colloidal organic matter, and mixtures thereof.

5. The improved process of claim 1 wherein the product of the anionic flotation is scrubbed with sulfuric acid and subsequently subjected to a cationic froth flotation.

6. A process for beneficiating phosphate ore comprising the steps of (a) sizing the phosphate ore, (b) washing the sized phosphate ore, and (c) subjecting the sized and washed phosphate ore to anionic froth flotation with a flotation collector to selectively recover the phosphate minerals wherein the flotation collector comprises a fatty acid based reagent comprising about 0.1–99.9% of a blend of ether sulfates selected from the group of ether sulfates consisting of an alkyl ether sulfate, an alkyl alcohol ether sulfate, and mixtures thereof with a petroleum sulfonate, wherein the blend is present in an amount in the range of about 1:99–99:1% by weight of the phosphate ore.

7. The process of claim 6 wherein the blend further comprises fuel oil in an amount ranging from about 20–80%, by weight.

8. The process of claim 6 wherein the blend further comprises water.

9. The process of claim 8 wherein the water further comprises a contaminant material selected from the group of materials consisting of phosphate clays, dissolved inorganic salts, colloidal organic matter, and mixtures thereof.

10. The process of claim 6 wherein the product of the anionic flotation is scrubbed with sulfuric acid and subsequently subjected to a cationic froth flotation.

11. The process of claim 6 wherein the sized and washed phosphate ore of step (c) has an average particle diameter size of from about 106 $\mu$m to about 1.18 mm.

12. The process of claim 11 wherein the sized and washed phosphate ore of step (c) has an average particle diameter size of from about 75 $\mu$m to about 1.18 mm.

* * * * *